US010765274B2

(12) United States Patent
Nakajima

(10) Patent No.: US 10,765,274 B2
(45) Date of Patent: Sep. 8, 2020

(54) PACKAGING CONTAINER AND METHOD FOR USING SAME

(71) Applicant: Mami Nakajima, Nagaoka (JP)

(72) Inventor: Mami Nakajima, Nagaoka (JP)

( * ) Notice: Subject to any disclaimer, the term of this patent is extended or adjusted under 35 U.S.C. 154(b) by 0 days.

(21) Appl. No.: 16/464,272

(22) PCT Filed: Dec. 1, 2016

(86) PCT No.: PCT/JP2016/085738
§ 371 (c)(1),
(2) Date: May 27, 2019

(87) PCT Pub. No.: WO2018/100713
PCT Pub. Date: Jun. 7, 2018

(65) Prior Publication Data

US 2020/0187729 A1 Jun. 18, 2020

(51) Int. Cl.
*A47K 10/42* (2006.01)
*A45D 44/00* (2006.01)
(Continued)

(52) U.S. Cl.
CPC ..... *A47K 10/421* (2013.01); *A45D 44/002* (2013.01); *B65D 75/5883* (2013.01); *B65D 83/0805* (2013.01); *A47K 2010/3273* (2013.01)

(58) Field of Classification Search
USPC ..... 206/207, 210, 219, 494
See application file for complete search history.

(56) References Cited

U.S. PATENT DOCUMENTS 4,220,244 A * 9/1980 Elmore ..... B65D 81/22 206/210
4,805,767 A * 2/1989 Newman ..... B65D 81/3266 206/219
(Continued)

FOREIGN PATENT DOCUMENTS

JP S62-87593 U 6/1987
JP H04-000287 U 1/1992
(Continued)

OTHER PUBLICATIONS

International Search Report for PCT/JP2016/085738 dated Feb. 14, 2017.
PCT written opinion dated Feb. 14, 2017.

*Primary Examiner* — Jacob K Ackun
(74) *Attorney, Agent, or Firm* — Yokoi & Co., U.S.A.; Toshiyuki Yokoi

(57) ABSTRACT

To hygienically store contents without the use of a stimulating reagent, such as a preservative. A packaging container for containing water absorptive contents 11 in which a liquid is impregnated, the packaging container being provided with: a container body 10 having an opening that can be opened and closed; a liquid enclosure member 50*a* which is disposed inside the container body 10 and in which liquid is enclosed; a bag body 30 contained inside the container body 10 in a state in which the contents 11 are enclosed; a pullout portion 31 that is a portion of the bag body 30 and is pulled out through a seal member 42; and a rupture section 30*b* for rupturing the bag body 30, the rupture section 30*b* being formed in one portion of the bag body 30. The seal member is provided with an opening 41 which is in communication with the interior of the container body 10, and a seal member 42 that blocks the opening 41 on the outer surface of the container body 10 and forms a re-attachable seal shape.

1 Claim, 5 Drawing Sheets

(51) Int. Cl.
*B65D 75/58* (2006.01)
*B65D 83/08* (2006.01)
*A47K 10/32* (2006.01)

(56) References Cited

U.S. PATENT DOCUMENTS 5,458,244 A * 10/1995 Emori ..... B65D 81/3272 206/219
5,492,219 A * 2/1996 Stupar ..... B65D 81/3266 206/219
5,988,371 A * 11/1999 Paley ..... A47K 10/32 206/229
6,082,534 A * 7/2000 Dotson ..... B65D 75/5805 15/104.93
6,164,441 A * 12/2000 Guy ..... B65D 75/5838 206/210
6,945,402 B1 9/2005 Gueret
6,978,889 B2 * 12/2005 McBride ..... B65D 83/0894 206/210
6,983,839 B2 * 1/2006 Bertram ..... B29C 44/183 206/219
7,618,406 B2 * 11/2009 Roger ..... A61J 1/2093 206/219
2002/0166779 A1 * 11/2002 Etesse ..... B65D 81/3272 206/219
2004/0089578 A1 * 5/2004 Lin ..... B65D 75/5838 206/494
2004/0118431 A1 * 6/2004 Flynn ..... A45D 37/00 134/6
2005/0207680 A1 * 9/2005 Schumacher ..... B65B 25/145 383/66
2005/0258062 A1 * 11/2005 Bando ..... A47K 10/421 206/494
2009/0208368 A1 * 8/2009 Waldrep ..... A61M 25/002 422/28
2009/0308764 A1 * 12/2009 Lee ..... A61F 15/001 206/219
2009/0308776 A1 * 12/2009 Seo ..... B65D 25/082 206/494
2010/0065445 A1 * 3/2010 Stevenson ..... A61Q 19/00 206/210
2016/0159534 A1 * 6/2016 Ujiie ..... B65D 75/5894 206/494
2016/0374919 A1 * 12/2016 Hakozaki ..... B65D 25/04 206/219

FOREIGN PATENT DOCUMENTS

JP 2002-543009 A 12/2002
JP 2003-125971 A 5/2003
JP 2005-112443 A 4/2005

* cited by examiner

PACKAGING CONTAINER AND METHOD FOR USING SAME

TECHNICAL FIELD

The present invention relates to a packaging container and a method for using same for containing water absorptive contents such as a portable wet sheet impregnated with a liquid such as water or skin lotion.

BACKGROUND ART

Conventionally, packaging containers for containing water absorptive contents in which a liquid is impregnated, include a container containing wet sheets as contents impregnated with a chemical liquid or the like. This wet sheet is convenient for childcare, medical care/nursing such as a cosmetic purpose, removing dirt and sweat of skin, care of the area surrounding a mouth, oral care, treatment of defecation and the like, and a variety of uses such as keeping a pet, cleaning a floor, a desk and an automobile so that the wet sheet is preferably used at ordinary homes, in a medical care site and so forth. As compared with usual dry sheets, this type of wet sheets is particularly effective because a stuck cosmetic material or dust can easily and quickly be wiped out and surely removed.

Conventional wet sheets are contained in a bag-shaped, box-shaped or cylindrical container which is provided with an opening formed to take out the wet sheet, and a lid member or a repeelable seal member for closing the opening which can be tightly closed to prevent the wet sheets from being dried. In accordance with this structure, since a wet sheet is taken out from the opening by wide opening the lid member or the seal member each time the wet sheet is used, there is a problem that a chemical liquid of the wet sheets is evaporated each time the wet sheet is used so that the wet sheets tend to be dried. Particularly, in the case of a soft packaging bag such as a portable bag, as compared with a hard box type or cylinder type wet sheet container, it is difficult to re-attach the lid member or the seal member in order to tightly seal up the opening.

In order to solve such a problem, as described in Patent Document 1, a packaging structure from which wet sheets can be taken out without opening a lid member is proposed. Namely, a wet sheet can be taken out without the need for peeling the seal member by providing a plurality of a first opening and a second opening on a packaging bag and having the wet sheet successively pass through the two openings. Furthermore, in the case of Patent Document 1, after taking out a wet sheet, the next wet sheet is exposed from a take-out port with only its head out so that the wet sheet can be successively taken out by gripping the head. Accordingly, it is possible to decrease the open area through which a wet sheet is taken out and prevent the wet sheet from being dried.

PRIOR ART DOCUMENTS

Patent Documents

[Patent Document 1] Japanese Unexamined Patent Application Publication No. 2005-112443

SUMMARY OF THE INVENTION

Problems to be Solved by the Invention

However, in the case of the packaging container disclosed in Patent Document 1, wet sheets are impregnated in a liquid while the wet sheets are contained in the packaging container before opening so that, in such a wet condition as compared with a dry condition, sundry bacteria and virus can easily adhere and proliferate so that sanitation is deteriorated. Contrary to this, in a conventional method as employed, an antiseptic agent, a bactericide, an antimicrobial agent or the like agent is blended. However, since a wet sheet or the like is used to be in direct contact with skins, blending a stimulating reagent, such as a preservative, may cause troubles such as allergy or rough skin depending upon user's constitution.

In order to solve the problem as described above, it is therefore an object of the present invention to provide a packaging container and a method for using same in which the packaging container contains water absorptive contents to be impregnated with a liquid such that the contents can be hygienically stored without making use of a stimulating reagent such as a preservative.

Means for Solving Problem

In order to accomplish the object as described above, the present invention is related to a packaging container which contains a water absorptive content to be impregnated with a liquid, comprising:

a container body provided with an opening and closing section which can be opened and closed;

a liquid enclosure member which is disposed in the container body and in which the liquid is enclosed;

a bag body disposed in the container body with the content which is enclosed therein;

a pullout portion which is a part of the bag body and to be pulled out through the opening and closing section; and a rupture section formed on a part of the bag body to rupture the bag body.

In accordance with the present invention, the water absorptive content is contained in the bag body in a dried state, and this bag body is further disposed in the container body. The water absorptive content is contained in the bag body in a dried state before opening, and the liquid enclosure member in which the liquid is enclosed is disposed separately from this bag body 30 in the container body, with the opening and closing section being sealed to provide a finished product. Then, when the product is used, first, the liquid contained in the liquid enclosure member is let flow into the inside of the container body by giving damage to the liquid enclosure member such as crushing to rupture the liquid enclosure member in advance of opening the opening and closing section. At this time, the content is contained in the bag body in a dried state, and not impregnated with the flowing liquid. In this state, after the liquid is diffused in the container body by kneading and shaking the container body, the opening and closing section is opened, and the pullout portion is pulled out from the inside of the container body. By this procedure, the water absorptive content in the bag body is exposed out of the bag body and impregnated with the surrounding liquid by absorption. The ruptured bag body can be taken out by pulling out the pullout portion through the opening and closing section with the content remaining in the container body.

In accordance with the present invention as described above, since the water absorptive content is contained in the bag body in a dried state before opening, and the liquid enclosure member in which the liquid is enclosed is disposed separately from this bag body in the container body, the content are not impregnated with the liquid, and it is possible to prevent sundry bacteria and virus from adhering and proliferating and improve sanitation while the content is contained in the packaging container before opening. Also, since the liquid is enclosed in the liquid enclosure member and isolated from outside air, there is no need for blending a stimulating reagent such as an antiseptic agent, a bactericide or an antimicrobial agent. Because of this, in accordance with the present invention, troubles such as allergy or rough skin can be prevented even if the contents are wet sheets or the like which is used in direct contact with skin.

Meanwhile, the above liquid used in the case of the present invention may be a variety of liquid components as long as troubles such as allergy or rough skin are not caused. Examples of such liquid components include tap water, distilled water, hard water, medium-hard water, soft water and super hard water, and also include function water or functional water such as hydrogen water, reduced water, natural water, pure water, raw water, electrolysis water, oxygen water, deep sea water, alkali ionized water, carbonated water, foam water, or still water.

Furthermore, in accordance with the present invention as described above, when the content is used, it is possible to cause the liquid contained in the liquid enclosure member to flow into the inside of the container body by giving damage such as pressing to rupture the liquid enclosure member in advance of opening the opening and closing section. Then, after the liquid is sufficiently diffused in the container body by kneading and shaking the container body, the content can be exposed out of the bag body by rupturing the bag body, and fully impregnated with the surrounding liquid.

In the case of the above invention, it is preferred that an admixture disposed outside of the bag body and provided to be mixed with the liquid enclosed in the liquid enclosure member. This admixture includes, for example, a flavoring agent, a reagent, a surface active agent, a moisturizing agent, a deodorizing agent, a preserving agent/bactericide, an exothermic agent, a coolant and the like. These materials can be used as a water solution or mixture thereof, an organic solution or solvent thereof, a capsule filled with these materials, freeze-dried powders, a solidified film, or any other preferred known form, and used as a mixture with the above described liquid component such as water.

In this case, in an unopened condition, since the component to be mixed with the liquid can be stored in a state separate from the liquid, it is possible to prevent the degradation of the component, the proliferation of sundry bacteria and virus and so forth to retain the freshness of the components, and further improve sanitation. Particularly, in the case of the present invention, since the liquid contained in the liquid enclosure member is caused to flow into the container body just before opening the opening and closing section, the liquid contained in the container body can be fully mixed with the admixture by kneading and shaking the container body to sufficiently diffuse the mixed liquid around the content and impregnate the content with the mixed liquid so that the content can uniformly absorb the liquid mixed with the admixture.

In the case of the above invention, it is preferred that the opening and closing section is constructed by an opening communicating with the inside of the container body, and a re-adhesive seal member which is located on the outside surface of the container body to close the opening. In this case, since the opening is closed by the re-adhesive seal member, it is possible to maintain an internal wet state even if the opening is repeatedly opened and closed and prevent sundry bacteria and virus from entering.

In the case of the above invention, it is preferred that the opening and closing section is constructed by an opening communicating with the inside of the container body, and a cap member in the form of a cap which is threaded into the opening to close the opening on the outside surface of the container body. In this case, since the opening is closed by the cap member which is threadedly engaged with the opening, it is possible to maintain an internal wet state even if the opening is repeatedly opened and closed and prevent sundry bacteria and virus from entering.

Furthermore, in the case of the above invention, it is preferred that the container body is provided with an opening section which is opened along a cut-off line and which is provided with a sealing section to seal the opening section, and that the pullout portion is releasably fixed to a member which is used to close the opening. In this case, the pullout portion of the bag body can be pulled out from the container body by the operation of opening the seal member or the cap member as described above, and therefore it is possible to dispense with a tedious operation of picking up the pullout portion through the opening and improve the user-friendliness of the product. Furthermore, with the opening section which is opened along a cut-off line, the content can easily be taken out by opening the opening section, and with the sealing section to close the opening section, it is possible to maintain an internal wet state even if the opening is opened and prevent sundry bacteria and virus from entering.

Effects of the Invention

In accordance with the packaging container of the present invention, as has been discussed above, since the content is not impregnated with the liquid before opening, it is possible to prevent sundry bacteria and virus from adhering to and proliferating on the content before opening, and since the liquid is enclosed in the liquid enclosure member and isolated from outside air, there is no need for blending a stimulating reagent such as an antiseptic agent, a bactericide or an antimicrobial agent. Because of this, in accordance with the present invention, the content can be hygienically provided while preventing troubles such as allergy or rough skin even if the contents are wet sheets or the like which is used in direct contact with skin.

MODE FOR CARRYING OUT THE INVENTION

First Embodiment (Overall Configuration of Packaging Container)

Figure 1:
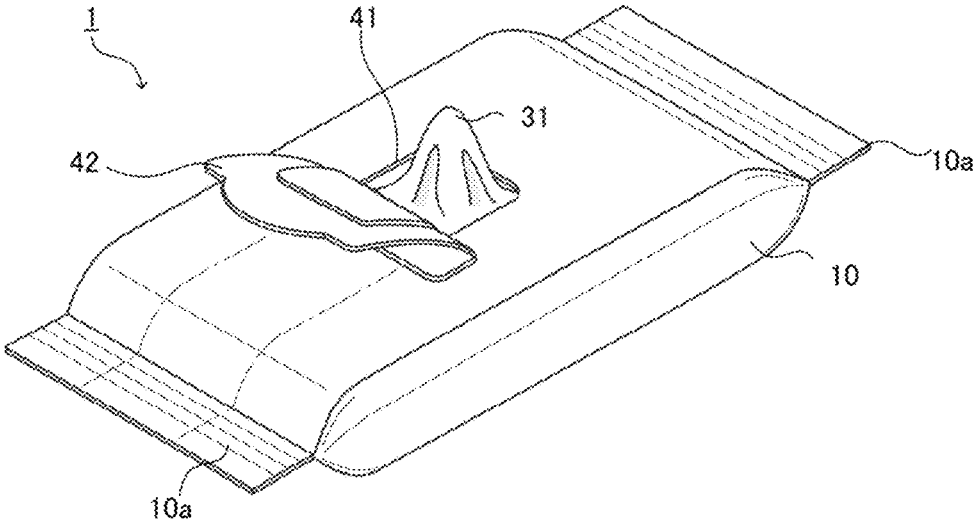
FIG. 1 is a perspective view for showing the overall configuration of a packaging container in accordance with a first embodiment.
Figure 2:
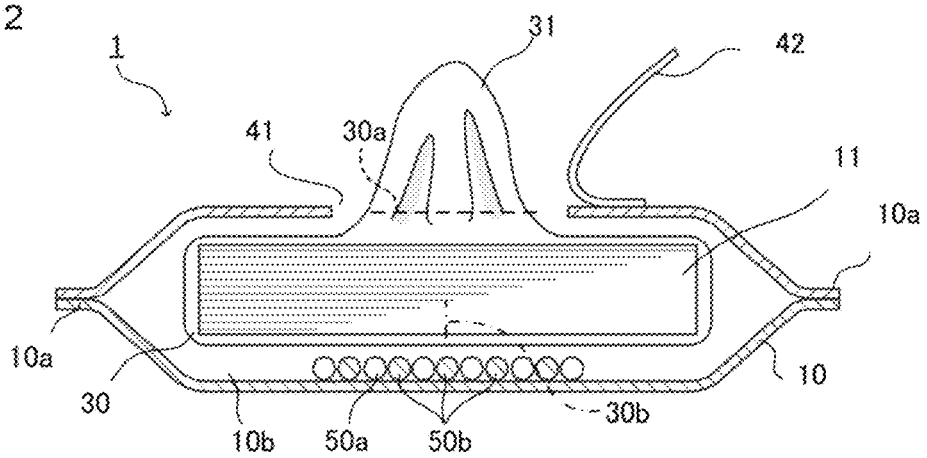
FIG. 2 is a cross sectional side view of the packaging container in accordance with the first embodiment.

In what follows, with reference to the accompanying drawings, a first embodiment of a packaging container in accordance with the present invention will be explained in detail. FIG. 1 is a perspective view for showing the overall configuration of the packaging container in accordance with the present embodiment, and FIG. 2 is a cross sectional side view thereof.

The packaging container 1 in accordance with the present embodiment can contain wet sheets or the like impregnated with a chemical liquid or the like, and can be used for childcare, medical care/nursing such as a cosmetic purpose, removing dirt and sweat of skin, care of the area surrounding a mouth, oral care, treatment of defecation and the like, and a variety of uses such as keeping a pet, cleaning a floor, a desk and an automobile. Specifically, as illustrated in FIG. 1 and FIG. 2, the packaging container 1 is generally composed of an internally hollow container body 10 which is a base element of the overall configuration and provided with a seal member 42 as an opening and closing section, a liquid enclosure member 50*a* disposed inside the container body 10, and a bag body 30.

The container body 10 is a rectangular package having the seal member 42, which can be opened or closed, and formed as a rectangular internally hollow container by heat bonding the perimeter and end portions 10*a* of a sheet made of aluminum, vinyl or the like material having high water resistance.

The contents 11 contained in the container body 10 are, for example, a vegetable fiber such as pulp, cotton or hemp, an animal fiber such as wool or silk, a regenerated fiber such as rayon or cupra, a half-synthetic fiber such as acetate or promix, a nonwoven fabric made of synthetic fiber or the like, paper made of natural pulp, synthetic pulp, or cloth made of gauze or the like in the form of a sheet material having wet strength, which is contained in a dry state.

The bag body 30 is an airtight bag body which is accommodated in the container body 10 and in which is enclosed the contents 11. The bag body 30 is made for example of thin vinyl, aluminum foil or the like. In the case of the present embodiment, the contents 11 such as water absorptive wet sheets in a dried state are contained in this bag body 30, which is in turn located in the container body 10 with the contents 11 contained therein.

In the case of the present embodiment, this bag body 30 includes a pullout portion 31 which is pulled out through an opening 41 and a rupture section 30*b* where the bag body 30 can be ruptured. The pullout portion 31 can be a salient portion, for example, a corner of the bag body 30, or a welding portion which is formed when the bag body 30 is formed by sticking. The rupture section 30*b* may be formed, for example, as a break line such as a perforation line formed in the bottom surface of the bag body, or a cut portion having a decreased thickness.

Figure 3:
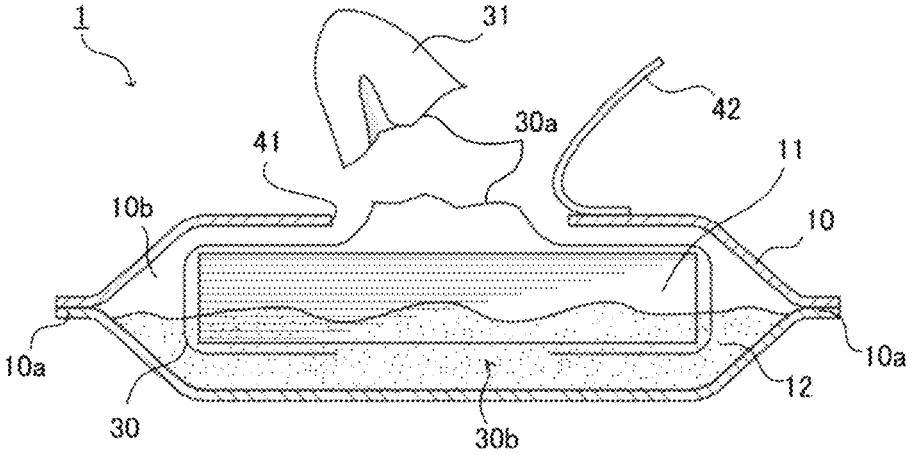
FIG. 3 is a cross sectional side view for showing a use example of the packaging container in accordance with the first embodiment.

Furthermore, in the case of the present embodiment, a cutoff line 30*a* is formed on the bag body 30 for cutting off the pullout portion 31. As illustrated in FIG. 3, after pulling out the pullout portion 31 and rupturing the rupture section 30*b* in the bottom side, the pullout portion 31 is torn off and removed along the cutoff line 30*a* with the main body of the bag body 30 remaining in the container body 10. An opening is formed in the upper side of the bag body 30 by cutting off the pullout portion 31 in this manner in order that a liquid is allowed to flow into the bottom side of the bag body through this opening, and that the contents can be taken out through the opening formed by cutting off the pullout portion without the need for removing the bag body 30.

The seal member 42, which serves as an opening and closing section, is a flexible member which is located in the upper side of the container body 10 and can be opened and closed. In the case of the present embodiment, the seal member 42 is a re-adhesive seal member which is located on the outside surface of the container body 10 and can close the opening 41 communicating with the inside of the container body 10. Meanwhile, in the case where the container body is bag-shaped, this opening and closing section is formed on the upper opening of the bag body, and this upper opening of the bag body can be openably closed, for example, with a chuck or zipper (trademark).

The opening 41 is a hole in the shape of a rectangle, an oval or the like having such an area that the contents 11 impregnated with a liquid can be picked up. The seal member 42 is made of a sealing material such as a re-attachable vinyl to which an adhesive is applied so that, since the opening 41 is closed by releasably attaching the seal member 42 to the perimeter of the opening 41, it is possible to maintain an internal wet state even if the opening 41 is repeatedly opened and closed and prevent sundry bacteria and virus from entering.

Alternatively, the pullout portion 31 may be releasably fixed to the seal member 42. In this case, the pullout portion 31 of the bag body 30 can be pulled out from the container body 10 by the operation of opening the seal member 42, and therefore it is possible to dispense with a tedious operation of picking up the pullout portion 31 through the opening 41 and improve the user-friendliness of the product.

The liquid enclosure member 50*a* is a simple container which is disposed in the container body 10 and in which is enclosed a liquid which is isolated from outside air. As this liquid enclosure member 50*a*, a plastic bag, a vacuum pack, a capsule, a plastic vessel can be adopted as long as a liquid can be sealed therein. While the bag body 30 is contained in the container body 10, this liquid enclosure member 50*a* is disposed separately from the bag body 30. This liquid enclosure member 50*a* is arranged in order to be crushed and ruptured due to a pressure force applied by giving damage to the liquid enclosure member 50*a*, such as pressing in the container body 10, in advance of opening to make the liquid contained therein flow into the inside of the container body 10.

Furthermore, in the case of the present embodiment, an admixture 50*b* is disposed inside the packaging container 1 and outside the bag body 30. This admixture 50*b* includes, for example, a cosmetic material, a medicine, a flavoring agent, a reagent, a surface active agent, a moisturizing agent, a deodorizing agent, a preserving agent/bactericide, an exothermic agent, a coolant and the like. These materials can be used as a water solution or mixture thereof, an organic solution or solvent thereof, a capsule filled with these materials, freeze-dried powders, a solidified film, or any other preferred known form, and used as a mixture with the above described liquid component such as water.

(Using Method)

Figure 4A:
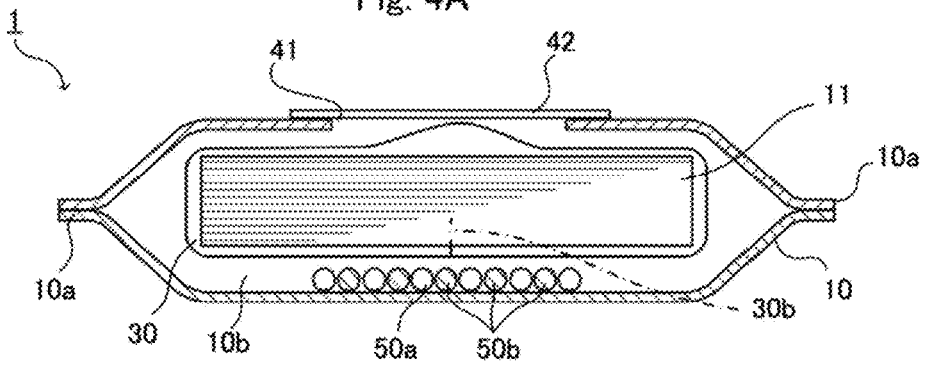
FIGS. 4A, 4B, 4C and 4D are explanatory views for showing a use mode of the packaging container in accordance with the first embodiment.

Next, the using method of the above described packaging container will be explained. FIGS. 4A-4D are cross sectional side views for showing the use state of the packaging container in accordance with the present embodiment. The packaging container 1 in accordance with the present embodiment includes, as illustrated in FIG. 4A, the water absorptive contents 11 are contained in the bag body 30 in a dried state before opening, and the liquid enclosure member 50*a* in which a liquid 12 is enclosed is disposed separately from this bag body 30 in the container body 10, with the opening and closing section being sealed to provide a finished product.

Figure 4B:
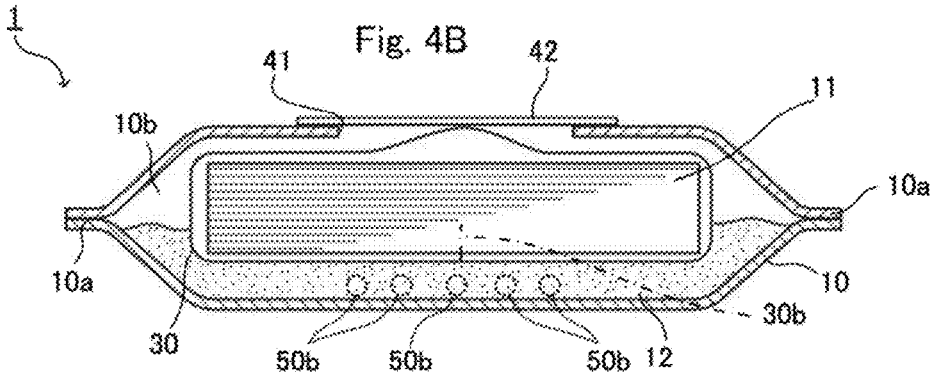

Then, when the product is used, as illustrated in FIG. 4B, at first, a pressure force is applied to the liquid enclosure member 50*a* in advance of opening the opening and closing section to rupture the liquid enclosure member 50*a* by giving damage to the liquid enclosure member 50*a* to make the liquid 12 contained in the liquid enclosure member 50*a* flow into the inside of the container body 10 in which the dried water absorptive contents 11 are contained. At this time, the contents are contained in the bag body in a dried state, and not impregnated with the flowing liquid. Meanwhile, in the case where the admixture 50*b* is used, the liquid 12 is fully mixed with the admixture 50*b* by kneading and shaking the container body 10 to sufficiently diffuse the mixed liquid around the contents 11.

Figure 4C:
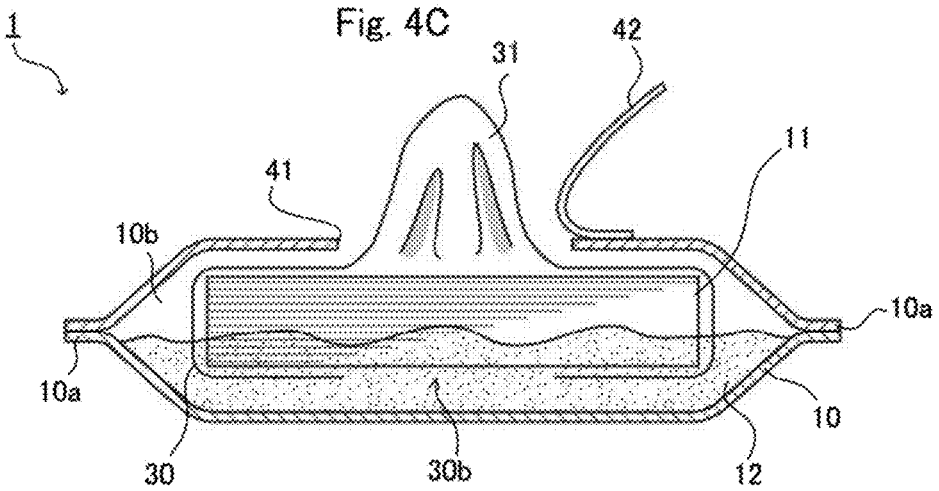

Next, as illustrated in FIG. 4C, the opening 41 is opened by peeling the seal member 42, and the exposed pullout portion 31 is gripped and pulled out with fingers. Then, in the container body 10, the rupture section 30*b* is broken by pulling out part or the entirety of the bag body 30 from the opening 41, and the contents 11 are exposed out of the bag body 30 and impregnated with the surrounding liquid by absorption. The broken bag body 30 can be taken out by pulling out the pullout portion 31 through the opening 41 with the contents 11 remaining in the container body 10.

Figure 4D:
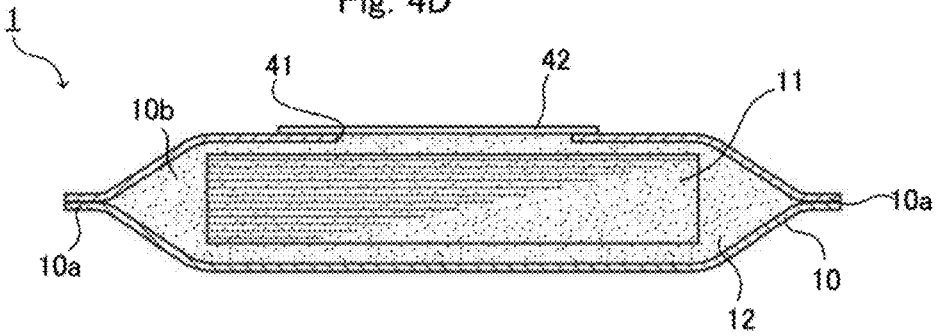

Alternatively, as illustrated in FIG. 3, the bag body 30 can be left in the container body 10 by tearing the pullout portion 31 along the cutoff line 30*a* after pulling out the pullout portion 31 and rupturing the rupture section 30*b* in the bottom side. An opening is formed in the upper side of the bag body 30 by cutting off the pullout portion 31 in this manner in order that a liquid is allowed to flow into the bottom side of the bag body through this opening, and that the contents 11 can be taken out through the opening formed by cutting off the pullout portion without the need for removing the bag body 30. In storage thereafter, as illustrated in FIG. 4D, the inside liquid is prevented from evaporating by closing the seal member 42.

(Actions/Effects)

In accordance with the present embodiment as described above, since the water absorptive contents 11 are contained in the bag body 30 in a dried state before opening, and the liquid enclosure member 50*a* in which the liquid 12 is enclosed is disposed separately from this bag body 30 in the container body 10, the contents 11 are not impregnated with the liquid 12, and it is possible to prevent sundry bacteria and virus from adhering and proliferating and improve sanitation while the contents 11 are contained in the container body 10 before opening. Also, since the liquid 12 is enclosed in the liquid enclosure member 50*a* and isolated from outside air, there is no need for blending a stimulating reagent such as an antiseptic agent, a bactericide or an antimicrobial agent, and troubles such as allergy or rough skin can be prevented even if the contents 11 are wet sheets or the like which is used in direct contact with skin.

Furthermore, when the contents 11 is used, it is possible to cause the liquid 12 contained in the liquid enclosure member 50*a* to flow into the inside of the container body 10 by giving damage such as pressing to rupture the liquid enclosure member 50*a* in advance of opening the seal member 42. Then, after the liquid 12 is sufficiently diffused in the container body 10 by kneading and shaking the container body 10, the contents 11 can be exposed out of the bag body 30 by pulling and removing the bag body 30, and fully impregnated with the surrounding liquid 12.

Furthermore, in accordance with the present embodiment as described above, the admixture 50*b* to be mixed with the liquid 12 contained in the liquid enclosure member 50*a* is further disposed outside of the bag body 30 so that, in an unopened condition, the component to be mixed with the liquid 12 can be stored in a state separate from the liquid 12, and therefore it is possible to prevent the degradation of the component, the proliferation of sundry bacteria and virus and so forth to retain the freshness of the components, and further improve sanitation. Particularly, in the case of the present invention, since the liquid 12 contained in the liquid enclosure member 50*a* is caused to flow into the container body 10 just before opening the seal member 42, the liquid contained in the container body 10 is fully mixed with the admixture 50*b* by kneading and shaking the container body 10 to sufficiently diffuse the mixed liquid around the contents 11 and impregnate the contents 11 with the mixed liquid, and thereby the contents can uniformly absorb the liquid mixed with the admixture 50*b*.

Second Embodiment

Figure 5A:
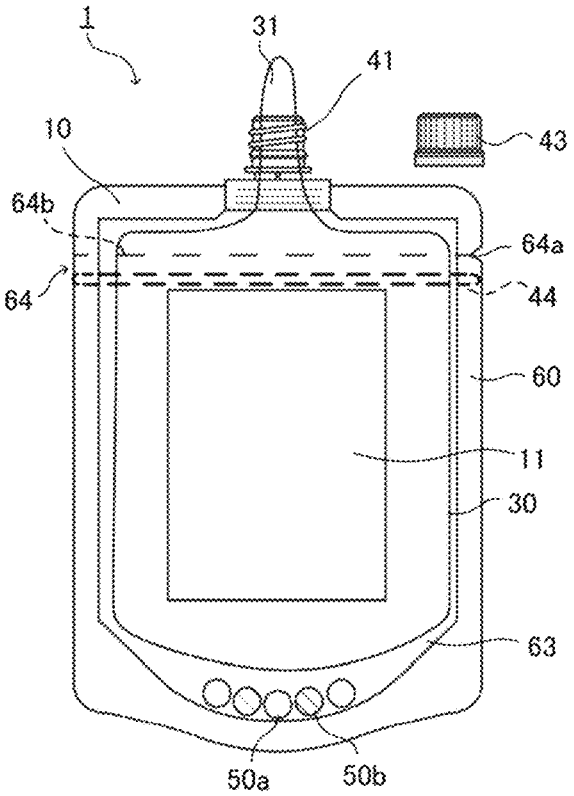
FIG. 5A is a transparent front view for showing the overall configuration of the packaging container in accordance with a second embodiment.
Figure 5B:
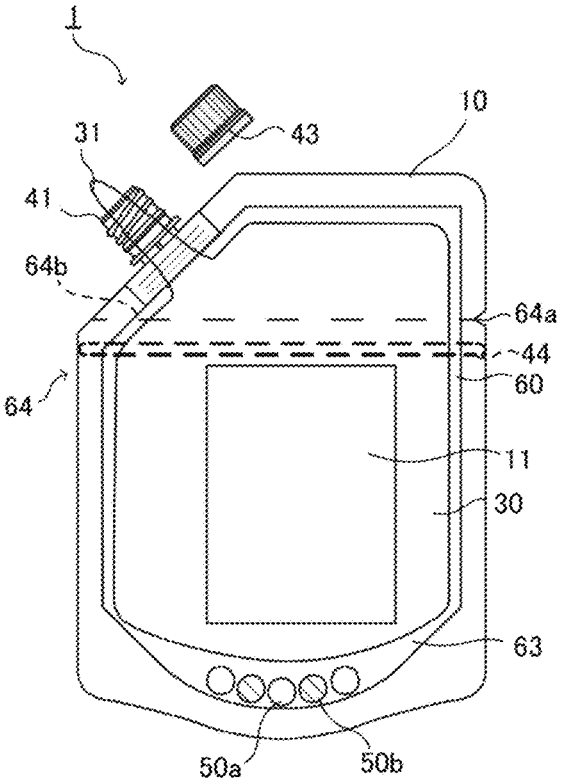
FIG. 5B shows an exemplary modification thereof.
Figure 6:
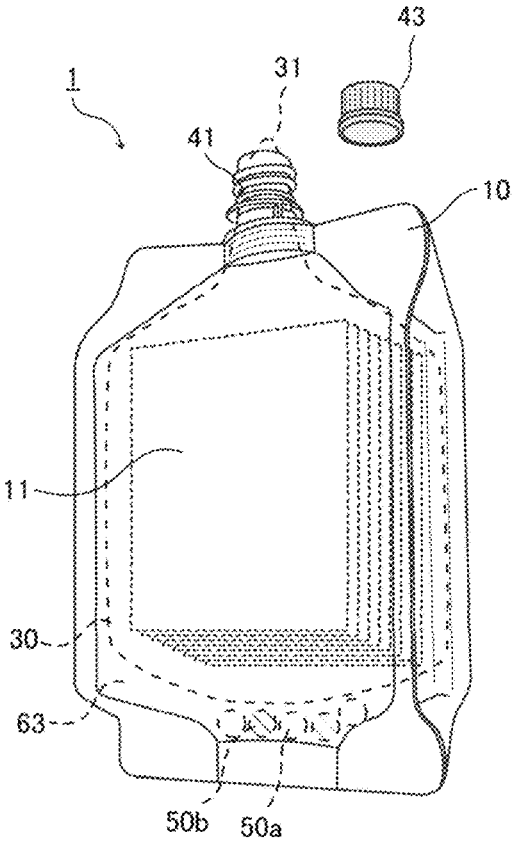
FIG. 6 is a perspective view for showing the overall configuration of the packaging container in accordance with the second embodiment.

In what follows, with reference to the accompanying drawings, a second embodiment of a packaging container in accordance with the present invention will be explained in detail. FIGS. 5A and 5B are transparent front views of the overall configuration of the packaging container in accordance with the second embodiment, and FIG. 6 is a transparent perspective view for showing the overall configuration of the packaging container in accordance with the second embodiment. Meanwhile, in the description of the present embodiment, like reference numbers indicate functionally similar elements as the above embodiment unless otherwise specified, and therefore no redundant description is repeated.

(Structure of Packaging Container)

As illustrated in FIG. 5A and FIG. 6, in the case of the present embodiment, a pack container 60 is provided with a cap which is used to close a container body thereof. An opening and closing section is formed by an opening 41 communicating with a hollow space 63 inside of the pack container 60 and a cap member 43 in the form of a cap which is threaded into the opening 41 to close the opening 41 on the outside surface of the container body 10.

The opening 41 can be opened and closed with the cap member 43 and used to additionally inject an admixture, a reagent, a cosmetic material or the like therethrough. By this procedure, the ingredients of the liquid contained in the container can be customized. Incidentally, the opening 41 and the cap member 43 can be located not only in the position as illustrated in the same figure (a), but also in such a position that the opening 41 is formed inclined on one side of an upper part of the pack container 60 as illustrated in the same figure (*b*).

The above pullout portion 31 may be releasably fixed to the cap member 43. In this case, the pullout portion 31 of the bag body 30 can be pulled out from the container body 10 by the operation of opening the cap member 43, and therefore it is possible to dispense with a tedious operation of picking up the pullout portion 31 through the opening 41 and improve the user-friendliness of the product.

Furthermore, in the case of the present embodiment, the pack container 60 is formed with an opening section 64 which can be torn from a notch 64*a* along a cut-off line 64*b* to open the pack container 60. This opening section 64 is provided with a zipper (trademark), a chuck or the like sealing section 44 to openably seal the opening. This sealing section is used to airtightly seal the opening of the opening section with a chuck or the like.

(Using Method 1)

Figure 7A:
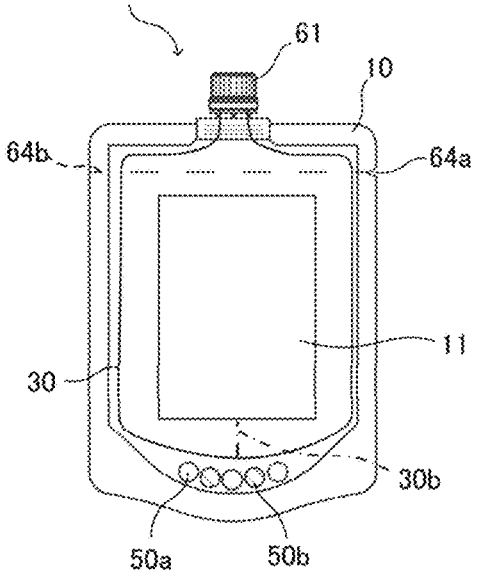
FIGS. 7A, 7B, 7C, 7D and 7E are explanatory views for showing a using method 1 in accordance with the second embodiment.

The packaging container having the structure as described above can be used by the using method of the present invention. FIGS. 7A-7E are explanatory views for showing the using method 1 in accordance with the present embodiment. In this using method, as illustrated in FIG. 7A, the bag body 30 contains the water absorptive contents 11 in a dried state before opening, and the liquid enclosure member 50*a* in which a liquid 12 is enclosed is disposed in the container body 10 separately from this bag body 30, with the opening and closing section being sealed with the cap member 43 to provide a finished product.

Figure 7B:
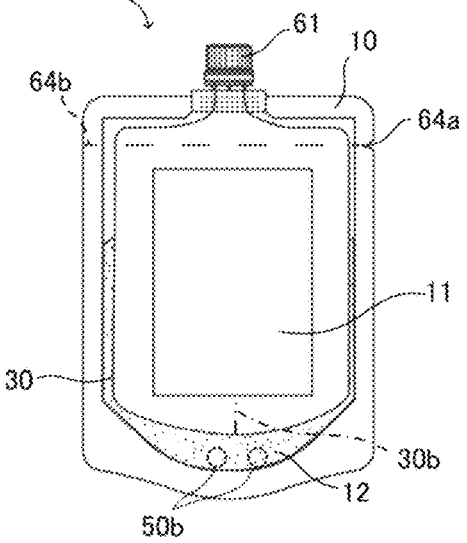

Then, when the product is used, as illustrated in FIG. 7B, at first, a pressure force is applied to the liquid enclosure member 50*a* in advance of opening the opening and closing section to rupture the liquid enclosure member 50*a* by giving damage to the liquid enclosure member 50*a* to make the liquid 12 contained in the liquid enclosure member 50*a* flow into the inside of the container body 10 in which the dried water absorptive contents 11 is contained. At this time, the contents are contained in the bag body in a dried state, and not impregnated with the flowing liquid. Meanwhile, in the case where the admixture 50*b* is used, the liquid 12 is fully mixed with the admixture 50*b* by kneading and shaking the container body 10 to sufficiently diffuse the mixed liquid around the contents 11. At this time, after removing the cap member 43 from the opening 41, an admixture, a reagent, a cosmetic material or the like can be additionally injected through the opening 41 to customize the ingredients of the liquid contained in the container.

Figure 7C:
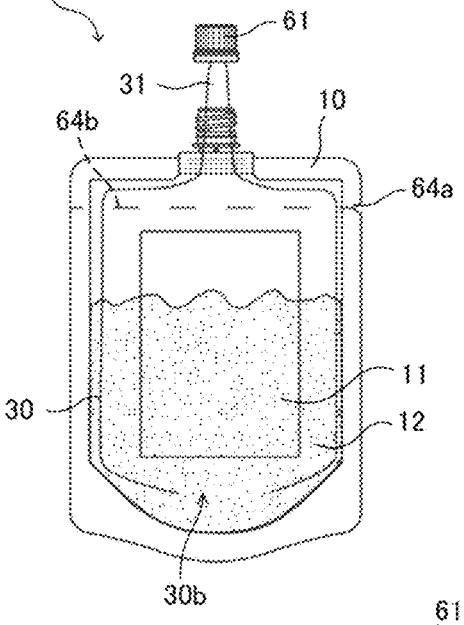
Figure 7D:
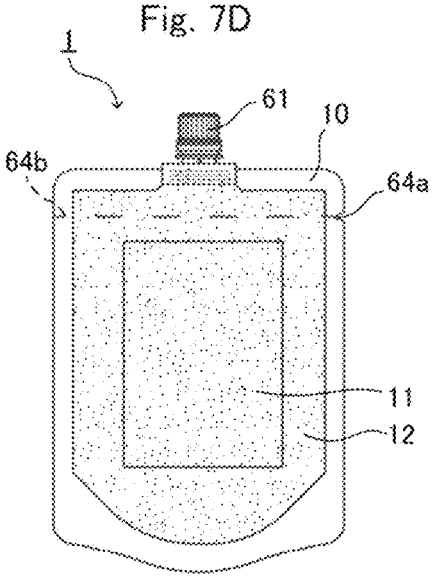

Next, as illustrated in FIG. 7C, the opening 41 is opened by removing the cap member 43, and the exposed pullout portion 31 is gripped and pulled out with fingers. Then, in the container body 10, the rupture section 30*b* is broken by pulling out the entirety of the bag body 30 from the opening 41, and the contents 11 is exposed out of the bag body 30 and impregnated with the surrounding liquid by absorption as illustrated in FIG. 7D.

Figure 7E:
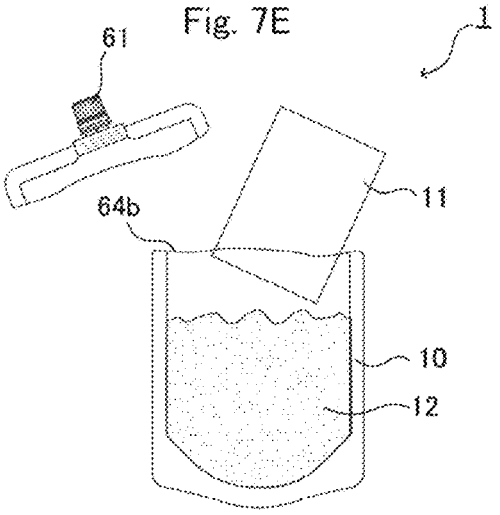

Thereafter, as illustrated in FIG. 7E, the opening section is opened by rupturing and removing an upper portion of the pack container 60 from the cut-off line 64*b*, and the broken bag body 30 is pulled and taken out with the contents 11 remaining in the container body 10. This opening section 64 can be opened and closed by the sealing section 44 such as a chuck so that the contents 11 can readily be taken out and used by opening the sealing section 44. In storage thereafter, the inside liquid is prevented from evaporating by sealing the sealing section 44 of the opening section 64.

(Using Method 2)

Figure 8A:
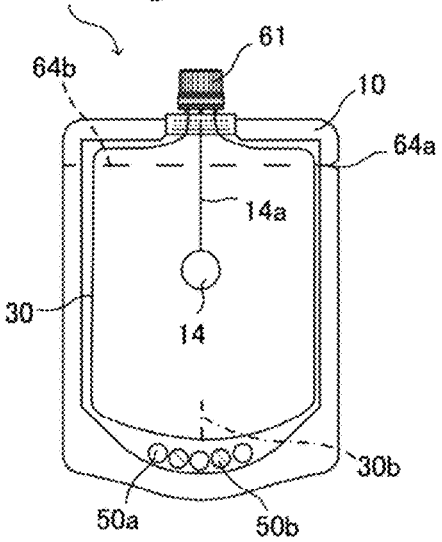
FIGS. 8A, 8B, 8C, 8D and 8E are explanatory views for showing a using method 2 in accordance with the second embodiment.

Next, another using method will be explained. FIGS. 8A-8E are explanatory views for showing the using method 2 in accordance with the present embodiment. As illustrated in FIG. 8A, a water absorptive content 14, which is made compact, is suspended with a thread 14*a* and contained in the bag body 30 in a dried state before opening the packaging container in accordance with this using method, and the liquid enclosure member 50*a* in which a liquid 12 is enclosed is disposed separately from this bag body 30 in the container body 10, with the opening and closing section being sealed by the cap member 43 to provide a finished product. Incidentally, the content 14 may be a mask or sheet which is used to entirely or partly cover a face, a neck or a body.

Figure 8B:
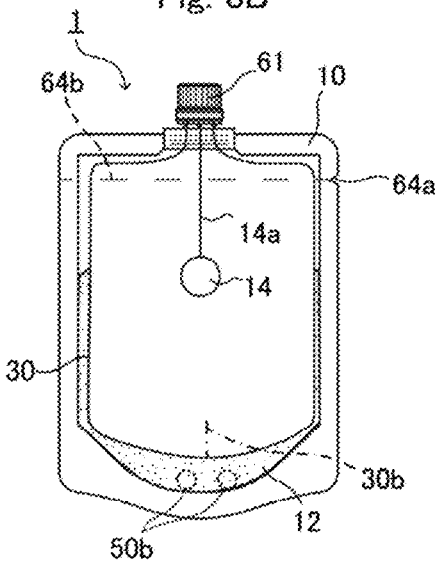

Then, when the product is used, as illustrated in FIG. 8B, at first, the liquid enclosure member 50*a* is broken by giving damage such as applying a pressure force to rupture the liquid enclosure member 50*a* to make the liquid 12 contained in the liquid enclosure member 50*a* flow into the inside of the container body 10 in which the dried water absorptive content 14 is contained. At this time, the content is contained in the bag body in a dried state, and not impregnated with the flowing liquid. Meanwhile, in the case where the admixture 50*b* is used, the liquid 12 is fully mixed with the admixture 50*b* by kneading and shaking the container body 10 to sufficiently diffuse the mixed liquid around the content 14. At this time, after removing the cap member 43 from the opening 41, an admixture, a reagent, a cosmetic material or the like can be additionally injected through the opening 41 to customize the ingredients of the liquid contained in the container.

Figure 8C:
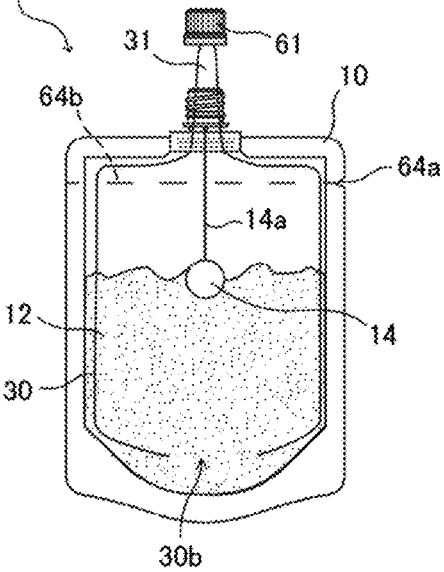
Figure 8D:
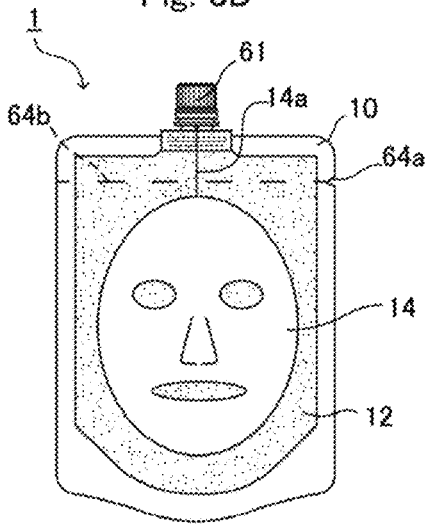

Next, as illustrated in FIG. 8C, the opening 41 is opened by removing the cap member 43, and the exposed pullout portion 31 is gripped and pulled out with fingers. Then, in the container body 10, the rupture section 30*b* is broken by pulling out the entirety of the bag body 30 from the opening 41, and the content 14 is exposed out of the bag body 30 and impregnated with the surrounding liquid by absorption as illustrated in FIG. 8C. By this process, the content 14 absorbs liquid and expands to recover the original size of a face mask.

Figure 8E:
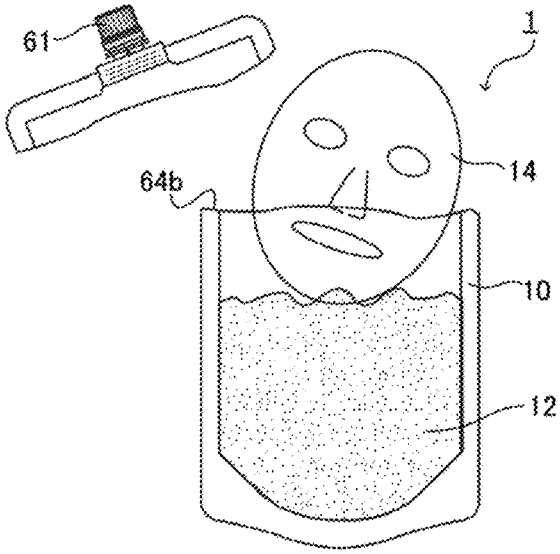

Thereafter, as illustrated in FIG. 8E, the opening section is opened by rupturing and removing an upper portion of the pack container 60 from the cut-off line 64*b*, and the broken bag body 30 is pulled and taken out with the content 14 remaining in the container body 10. This opening section 64 can be opened and closed by the sealing section 44 such as a chuck so that the content 14 can readily be taken out and used by opening the sealing section 44. In storage thereafter, the inside liquid is prevented from evaporating by sealing the sealing section 44 of the opening section.

Incidentally, while the content 14 is suspended in the bag body 30 with the thread 14*a* in accordance with the using method 2 as explained above, the bag body 30 can be dispensed with because the content 14 is prevented by the thread 14*a* from coming in contact with the liquid 12 before opening. On the other hand, in the case where the content 14 is prevented by the bag body 30 from coming in contact with the liquid 12 before opening, the thread 14*a* may be dispensed with.

(Actions/Effects)

In accordance with the present embodiment as explained above, since the opening 41 is closed by the cap member 43 which is threadedly engaged with the opening 41, it is possible to maintain an internal wet state even if the opening 41 is repeatedly opened and closed and prevent sundry bacteria and virus from entering. In addition, the opening 41 can be opened and closed with the cap member 43 and used to additionally inject an admixture, a reagent, a cosmetic material or the like therethrough, and thereby it is possible to customize the ingredients of the liquid contained in the container.

Furthermore, in accordance with the present embodiment, the pullout portion 31 of the bag body 30 can be pulled out from the container body 10 by the operation of opening the cap member 43, and therefore it is possible to dispense with a tedious operation of picking up the pullout portion 31 through the opening 41 and improve the user-friendliness of the product.

Modification Example

Incidentally, the embodiments as described above are examples of the present invention. Because of this, the present invention is not limited to the above embodiments, and various modifications are possible in accordance with the design and so forth without departing from the technical spirit of the invention. For example, while the cap and the seal are used in the embodiments as described above, such cap and seal can be omitted as a disposable type which is opened simply by tearing and removing part of the container, or as a resealable type having a chuck, zipper or the like for opening.

DESCRIPTION OF REFERENCE SIGNS

1 . . . packaging container
10 . . . container body
10*a* . . . end portion
11, 14 . . . content
12 . . . liquid
14*a* . . . thread
30 . . . bag body
30*a* . . . cutoff line
30*b* . . . rupture section
31 . . . pullout portion
41 . . . opening
42 . . . seal member
43 . . . cap member
44 . . . adhesion section
50*a* . . . liquid enclosure member
50*b* . . . admixture
60 . . . pack container
63 . . . hollow space
64 . . . opening section
64*a* . . . notch
64*b* . . . cut-off line

What is claimed is:

1. A method of using a packaging container which contains a water absorptive content to be impregnated with a liquid, the packaging container comprising:

a container body provided with an opening and closing section which can be opened and closed;

a liquid enclosure member which is disposed in the container body and in which the liquid is enclosed;

a bag body disposed in the container body with the content which is enclosed therein;

a pullout portion which is a part of the bag body and to be pulled out through the opening and closing section; and a rupture section formed on a part of the bag body to rupture the bag body, wherein after the liquid enclosed in the liquid enclosure member is diffused over the inside of the container body and outside of the bag body by rupturing the liquid enclosure member disposed in the container body with the opening and closing section of the container body being closed, the opening and closing section is opened, and the bag body is ruptured at the rupture section by pulling the pullout portion through the opening and closing section to impregnate the content with the liquid.

* * * * *